US008913923B2

(12) United States Patent
Kosuge et al.

(10) Patent No.: US 8,913,923 B2
(45) Date of Patent: Dec. 16, 2014

(54) IMAGE FORMING APPARATUS WITH NEUTRALIZER AND IMAGE FORMING METHOD

(75) Inventors: Akio Kosuge, Kanagawa (JP); Shinichi Kawahara, Tokyo (JP); Nobuo Kuwabara, Kanagawa (JP); Takeshi Shintani, Kanagawa (JP); Norio Kudo, Kanagawa (JP); Daisuke Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 13/489,063

(22) Filed: Jun. 5, 2012

(65) Prior Publication Data

US 2012/0328332 A1 Dec. 27, 2012

(30) Foreign Application Priority Data

Jun. 22, 2011 (JP) ..... 2011-138596
Feb. 15, 2012 (JP) ..... 2012-030707

(51) Int. Cl.
*G03G 21/08* (2006.01)

(52) U.S. Cl.
CPC ..... *G03G 21/08* (2013.01)
USPC ..... 399/128

(58) Field of Classification Search
CPC ..... G03G 21/08
USPC ..... 399/127, 128
See application file for complete search history.

(56) References Cited

U.S. PATENT DOCUMENTS

| | | | | |
|---|---|---|---|---|
| 5,631,727 | A * | 5/1997 | Ehara et al. | 399/131 |
| 6,768,879 | B2 | 7/2004 | Kosuge | |
| 7,155,152 | B2 * | 12/2006 | Iwai et al. | 399/296 |
| 7,702,257 | B2 | 4/2010 | Kosuge | |
| 7,756,439 | B2 | 7/2010 | Kosuge et al. | |
| 7,873,291 | B2 | 1/2011 | Kosuge et al. | |
| 2007/0297830 | A1 | 12/2007 | Kosuge | |
| 2010/0183349 | A1 | 7/2010 | Shintani et al. | |

FOREIGN PATENT DOCUMENTS

| | | |
|---|---|---|
| JP | 2001-188451 | 7/2001 |
| JP | 2007-47670 | 2/2007 |
| JP | 2009-8906 | 1/2009 |

* cited by examiner

*Primary Examiner* — Gregory H Curran
(74) *Attorney, Agent, or Firm* — Oblon, Spivak, McClelland, Maier & Neustadt, L.L.P.

(57) ABSTRACT

An image forming apparatus including an image bearing member, a charger, an irradiator, a developing device, a transfer device, a neutralizer, and a varying device is provided. The neutralizer is adapted to neutralize the image bearing member by emitting neutralization light thereto, after a toner image formed on the image bearing member is transferred therefrom. The varying device is adapted to vary an amount of the neutralization light to be emitted to the image bearing member by pulse-width modulation of a voltage to be supplied to the neutralizer. The image forming apparatus satisfies the following formula:

$$f/V>5$$

wherein f (Hz) represents a frequency of the pulse-width modulation and V (mm/s) represents a linear speed of the image bearing member.

8 Claims, 4 Drawing Sheets

IMAGE FORMING APPARATUS WITH NEUTRALIZER AND IMAGE FORMING METHOD

CROSS-REFERENCE TO RELATED APPLICATIONS

This patent application is based on and claims priority pursuant to 35 U.S.C. §119 to Japanese Patent Application Nos. 2011-138596 and 2012-030707, filed on Jun. 22, 2011 and Feb. 15, 2012, respectively, in the Japanese Patent Office, the entire disclosure of each of which is hereby incorporated herein by reference.

BACKGROUND

1. Technical Field

The present disclosure relates to an image forming apparatus with a neutralizer and an image forming method.

2. Description of Related Art

In electrophotography, an imaging history on a photoreceptor is generally eliminated by neutralizing the photoreceptor by emitting light thereto. Light emitted to a photoreceptor for the purpose of neutralizing it is hereinafter referred to as "neutralization light".

Japanese Patent Application Publication No. 2001-188451 discloses an image forming device including a detector for detecting the amount of neutralization light. The amount of neutralization light is adjusted by pulse-width modulation based on the detected value.

Japanese Patent Application Publication No. 2007-47670 discloses an image forming apparatus in which the amount of neutralization light is varied by repeating emission and extinction of the neutralization light at an interval of 4 to 100 mS.

Japanese Patent Application Publication No. 2009-8906 discloses an image forming device in which the amount of neutralization light is varied by pulse-width modulation according to the timing of switching transfer bias or the linear speed of photoreceptor.

SUMMARY

In accordance with some embodiments, an image forming apparatus comprising an image bearing member, a charger, an irradiator, a developing device, a transfer device, a neutralizer, and a varying device is provided. The charger is adapted to charge the image bearing member. The irradiator is adapted to irradiate the charged image bearing member with light to form an electrostatic latent image thereon. The developing device is adapted to develop the electrostatic latent image into a toner image with toner. The transfer device is adapted to transfer the toner image from the image bearing member. The neutralizer is adapted to neutralize the image bearing member by emitting neutralization light thereto. The varying device is adapted to vary an amount of the neutralization light to be emitted to the image bearing member by pulse-width modulation of a voltage to be supplied to the neutralizer. The image forming apparatus satisfies the following formula:

$$f/V>5$$

wherein f (Hz) represents a frequency of the pulse-width modulation and V (mm/s) represents a linear speed of the image bearing member.

In accordance with some embodiments, an image forming method is provided. The method includes charging an image bearing member, irradiating the charged image bearing member with light to form an electrostatic latent image thereon, developing the electrostatic latent image into a toner image with toner, transferring the toner image from the image bearing member, neutralizing the image bearing member by emitting neutralization light thereto, and varying an amount of the neutralization light to be emitted to the image bearing member by pulse-width modulation of a voltage to be supplied to the neutralizer. The method satisfies the following formula:

$$f/V>5$$

wherein f (Hz) represents a frequency of the pulse-width modulation and V (mm/s) represents a linear speed of the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
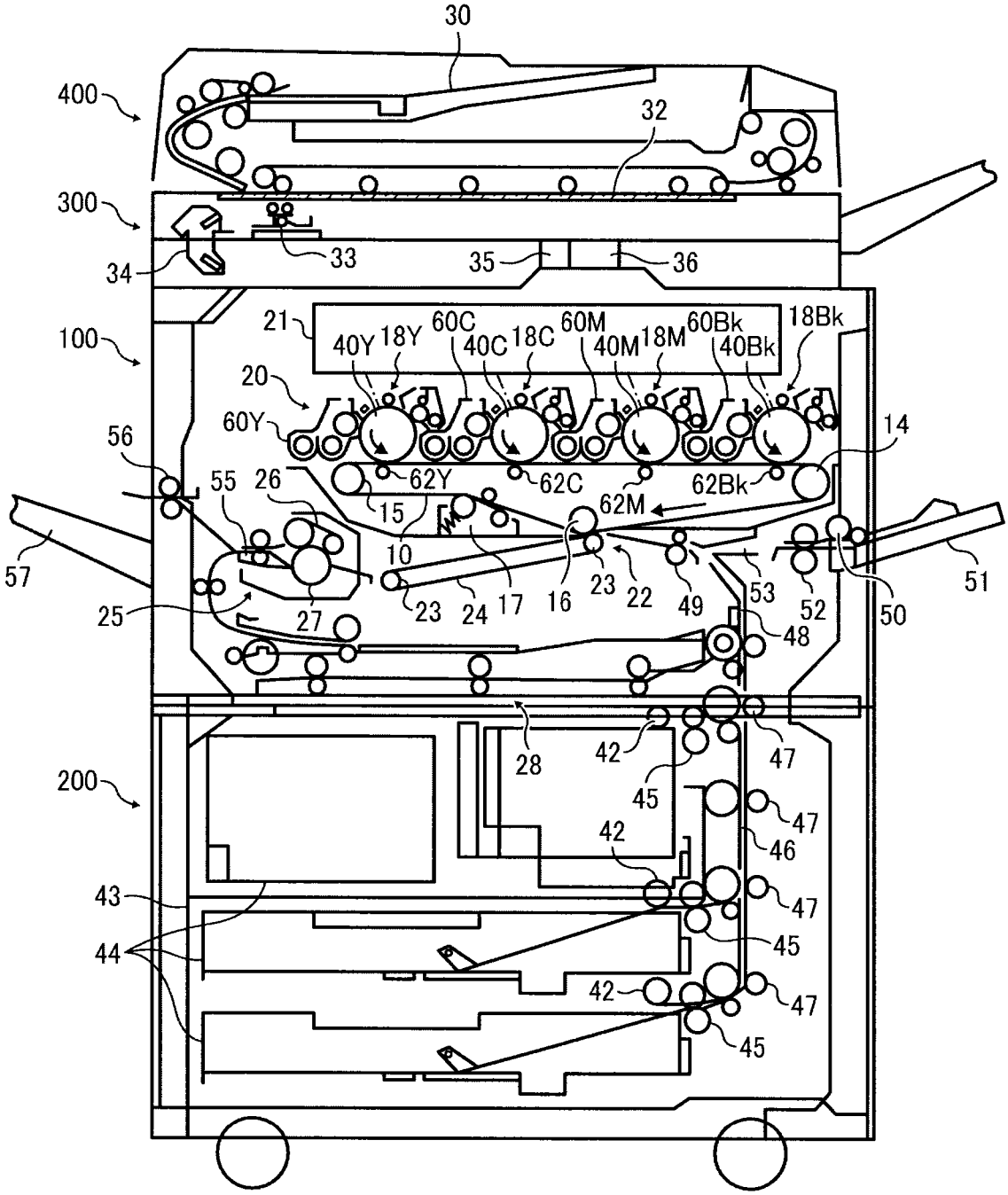
FIG. 1 is a schematic view of an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment. This image forming apparatus is a full-color copier employing a tandem intermediate transfer method.

The image forming apparatus includes a main body 100, a paper feed table 200 disposed below the main body 100, a scanner 300 disposed above the main body 100, and an automatic document feeder (ADF) 400 disposed above the scanner 300.

A tandem image forming apparatus 20 is disposed at the center part of the main body 100. The tandem image forming apparatus 20 includes four image forming units 18Y, 18C, 18M, and 18Bk arranged in tandem adapted to form images of yellow, cyan, magenta, and black, respectively. The image forming units 18Y, 18C, 18M, and 18Bk contain respective photoreceptors 40Y, 40C, 40M, and 40Bk serving as image bearing members.

An irradiator 21 is disposed above the tandem image forming apparatus 20. The irradiator 21 is comprised of four laser diode optical sources corresponding to the four colors, a polygon scanner including a hexagonal polygon mirror and a polygon motor, an fθ lens disposed on each optical path, and other lenses and mirrors such as a long WTL. Each of the laser diode optical sources emits laser light containing image information. The polygon scanner scans each photoreceptor with the deflected laser light.

A seamless intermediate transfer belt 10 is disposed below the tandem image forming apparatus 20. The intermediate transfer belt 10 is stretched across support rollers 14, 15, and 16 and is rotatable clockwise in FIG. 1. The support roller 14 is a driving roller adapted to rotary drive the intermediate transfer belt 10.

Between the first and second support rollers 14 and 15, primary transfer rollers 62Y, 62C, 62M, and 62Bk are disposed facing the respective photoreceptors 40Y, 40C, 40M, and 40Bk with the intermediate transfer belt 10 therebetween. The primary transfer rollers 62Y, 62C, 62M, and 62Bk are adapted to transfer a toner image from the respective photoreceptors 40Y, 40C, 40M, and 40Bk onto the intermediate transfer belt 10.

An intermediate transfer belt cleaner 17 is disposed downstream from the third support roller 16 with respect to the direction of rotation of the intermediate transfer belt 10. The intermediate transfer belt cleaner 17 is adapted to remove residual toner particles remaining on the intermediate transfer belt 10 without being transferred.

The intermediate transfer belt 10 may be comprised of, for example, a resin material, such as polyvinylidene fluoride, polyimide, polycarbonate, or polyethylene terephthalate, which is molded into a seamless belt. These materials may be mixed with a conductive material, such as carbon black, for the purpose of controlling resistivity. The intermediate transfer belt 10 may have a multilayer structure including a base layer comprised of the resin material and a surface layer formed by spraying or dipping.

A secondary transfer device 22 is disposed below the intermediate transfer belt 10. The secondary transfer device 22 is comprised of a pair of rollers 23 and a seamless secondary transfer belt 24 stretched between the rollers 23. The secondary transfer belt 24 is pressed against the third support roller 16 with the intermediate transfer belt 10 therebetween. The secondary transfer device 22 is adapted to transfer a toner image from the intermediate transfer belt 10 onto a recording medium.

The secondary transfer belt 24 may be comprised of the same material as the intermediate transfer belt 10.

A fixing device 25 is disposed adjacent to the secondary transfer device 22. The fixing device 25 is adapted to fix a toner image on a recording medium. The fixing device 25 includes a seamless fixing belt 26 and a pressing roller 27 pressed against the fixing belt 26.

The secondary transfer device 22 has a function of conveying a sheet of recording material onto which a toner image is transferred to the secondary transfer device 22. When the secondary transfer device 22 is comprised of a roller or a charger, a sheet conveyer may be disposed separately.

A reversing device 28 adapted to reverse a sheet of recording medium in duplexing is disposed below the secondary transfer device 22 and the fixing device 25 an in parallel with the tandem image forming apparatus 20.

In a copying operation, a document is set on a document table 30 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light to the document and reflects light reflected from the document toward the second runner 34. The second runner 34 then reflects the light toward a reading sensor 36 through an imaging lens 35. Thus, image information of the document is read.

Thereafter, an image forming operation is started based on the mode set in an operation part. Alternatively, in a case in which the automatic selection mode is set in the operation part, an image forming operation, either full-color mode or black-and-white mode, is started based on the image information of the document.

Figure 2:
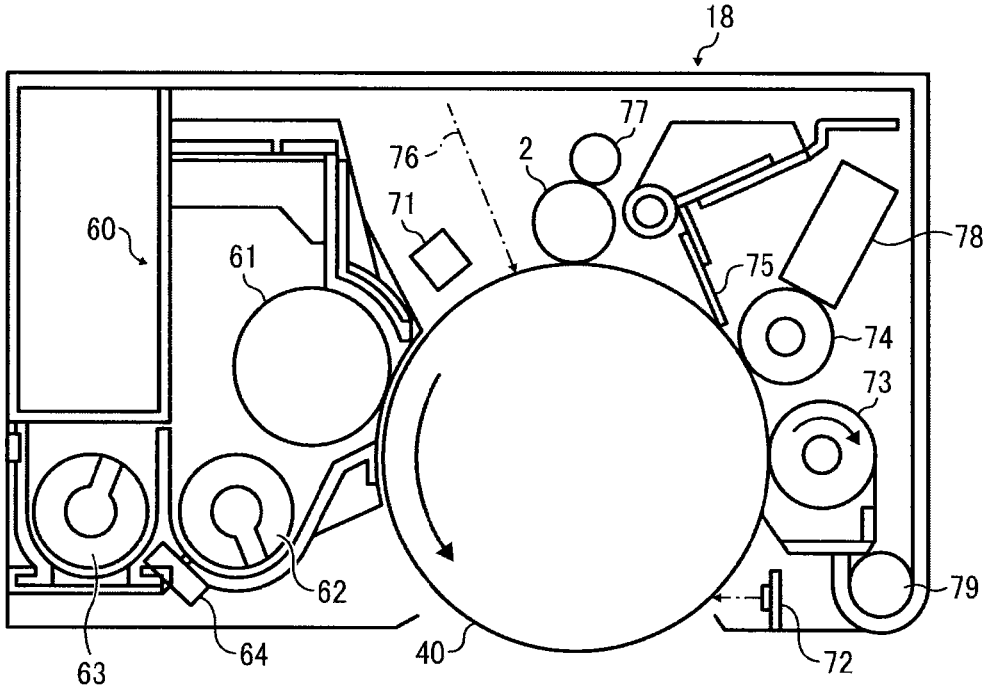
FIG. 2 is a schematic view of an image forming unit mountable on an image forming apparatus according to an embodiment.

When a full-color mode is selected, the photoreceptors 40Y, 40C, 40M, and 40Bk (hereinafter collectively "photoreceptor 40") start rotating counterclockwise as illustrated in FIG. 2. A surface of each photoreceptor 40 is uniformly charged by a charging roller 2. The charged surface of each photoreceptor 40 is irradiated with laser light 76 containing image information emitted from the irradiator 21 so that a latent image is formed on the photoreceptor 40. The latent image is developed into a toner image of yellow, cyan, magenta, or black with respective developing devices 60Y, 60C, 60M, or 60Bk as the photoreceptor 40 rotates.

The toner images are sequentially transferred from each photoreceptor 40 onto the intermediate transfer belt 10 as the intermediate transfer belt 10 travels. Thus, a composite full-color toner image is formed thereon. After the toner image has been transferred, the photoreceptor 40 is neutralized by emitting light from a neutralization lamp and residual toner particles are removed by cleaners, to be described in detail later.

On the other hand, upon pressing of the switch, one of paper feed rollers 42 starts rotating in the paper feed table 200 so that a sheet of recording medium is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is then stopped by a pair of registration rollers 49.

Alternatively, a sheet of recording medium may be fed from a manual feed tray 51 by rotating a paper feed roller 50. In this case, a separation roller 52 separates the sheet and feeds it to a manual paper feed path 53. The sheet is then stopped by the pair of registration rollers 49. The pair of registration rollers 49 feeds the sheet to the gap defined between the intermediate transfer belt 10 and the secondary transfer device 22 in synchronization with an entry of the composite full-color toner image formed on the intermediate transfer belt 10 into the gap. Thus, the composite full-color toner image is transferred onto the sheet.

The sheet having the toner image thereon is fed from the secondary transfer device 22 to the fixing device 25. The fixing device 25 fixes the toner image on the sheet by application of heat and pressure. The sheet having the fixed toner image thereon is then switched by a switch claw 55 and discharged by a pair of discharge rollers 56 onto a discharge tray 57.

Alternatively, the switch claw 55 switches paper feed paths so that the sheet gets reversed in the sheet reversing device 28. After forming another toner image on the back side of the sheet, the sheet is discharged onto the discharge tray 57 by rotation of the pair of discharge rollers 56. When the copier is instructed to form image on two or more sheets, the above-described image forming processes are repeated.

After completion of image formation on a predetermined number of sheets, a post-imaging treatment is performed. Thereafter, the photoreceptor 40 stops rotating. In the post-imaging treatment, residual charges on the photoreceptor 40 are removed by a neutralizer while the photoreceptor 40 is rotated more than once without supplying the charging or transfer bias thereto. By this treatment, the photoreceptor 40 is prevented from deteriorating.

When a black-and-white mode is selected, the support roller 15 moves downward so that the intermediate transfer belt 10 is separated from the photoreceptors 40Y, 40C, and 40M. Only the photoreceptor 40Bk starts rotating counter-clockwise as illustrated in FIG. 2. A surface of the photoreceptor 40Bk is uniformly charged by the charging roller 2. The charged surface is irradiated with laser light containing black image information to form a latent image thereon. The latent image is developed into a toner image with black toner.

The toner image is then transferred onto the intermediate transfer belt 10. At that time, the photoreceptors 40Y, 40C, and 40M and the developing devices 60Y, 60C, and 60M are suspended so as not to wear the photoreceptors 40Y, 40C, and 40M or waste developers in the developing devices 60Y, 60C, and 60M.

On the other hand, a sheet of recording medium is fed from the paper feed cassette 44 and further fed to the gap defined between the intermediate transfer belt 10 and the secondary transfer device 22 in synchronization with an entry of the toner image formed on the intermediate transfer belt 10 into the gap. The toner image is fixed on the sheet of recording medium in the fixing device 25. The sheet having the fixed toner image thereon is discharged through paper paths according to the mode designated. When the copier is instructed to form image on two or more sheets, the above-described image forming processes are repeated.

FIG. 2 is a schematic view of each of the image forming units 18. Around the photoreceptor 40, a charging roller 2 adapted to uniformly charge the photoreceptor 40, a cleaning roller 77, a potential sensor 71 adapted to detect potential of the photoreceptor 40, a developing device 60 adapted to develop an electrostatic latent image formed on the photoreceptor 40 into a toner image, a neutralization lamp 72 adapted to neutralize a surface of the photoreceptor 40 after a toner image is transferred therefrom, and a cleaning device adapted to remove residual toner particles therefrom, are disposed. The cleaning device is comprised of brush rollers 73 and 74 and a cleaning blade 75. The casing of the image forming unit 18 has an opening that allows the light beam 76 emitted from the irradiator to pass through.

In the present embodiment, the photoreceptor 40 employs an organic photoreceptor and the neutralization lamp 72 employs a light-emitting diode for emitting light having a wavelength of 600 to 800 nm. Both the organic photoreceptor and light-emitting diode are cheap materials, which is advantageous for providing high quality image forming apparatus at low cost.

The brush roller 74 is in contact with a solid lubricant 78. The brush roller 74 is adapted to supply the lubricant to the photoreceptor 40. Specific materials usable as the solid lubricant 78 include, but are not limited to, metal salts of fatty acids, such as zinc stearate, barium stearate, iron stearate, nickel stearate, cobalt stearate, copper stearate, strontium stearate, calcium stearate, magnesium stearate, zinc oleate, cobalt oleate, magnesium oleate, and zinc palmitate; natural waxes such as carnauba wax; and fluorine-based resins such as polytetrafluoroethylene. These materials may be optionally mixed with other materials. The solid lubricant 78 can be obtained by melt-solidifying or compression-molding lubricant particles.

The cleaning blade 75 may be comprised of a polyurethane rubber. Toner particles removed from the photoreceptor 40 by the brush rollers 73 and 74 and the cleaning blade 75 are collected by a toner feed coil 79 and fed to a waste toner tank.

In the present embodiment, the photoreceptor 40 is neutralized first and subsequently cleaned. According to another embodiment, the photoreceptor 40 may be cleaned first and subsequently neutralized.

In the present embodiment, the brush roller 74, i.e., a lubricant supply brush, is disposed within the cleaning device.

Figure 3:
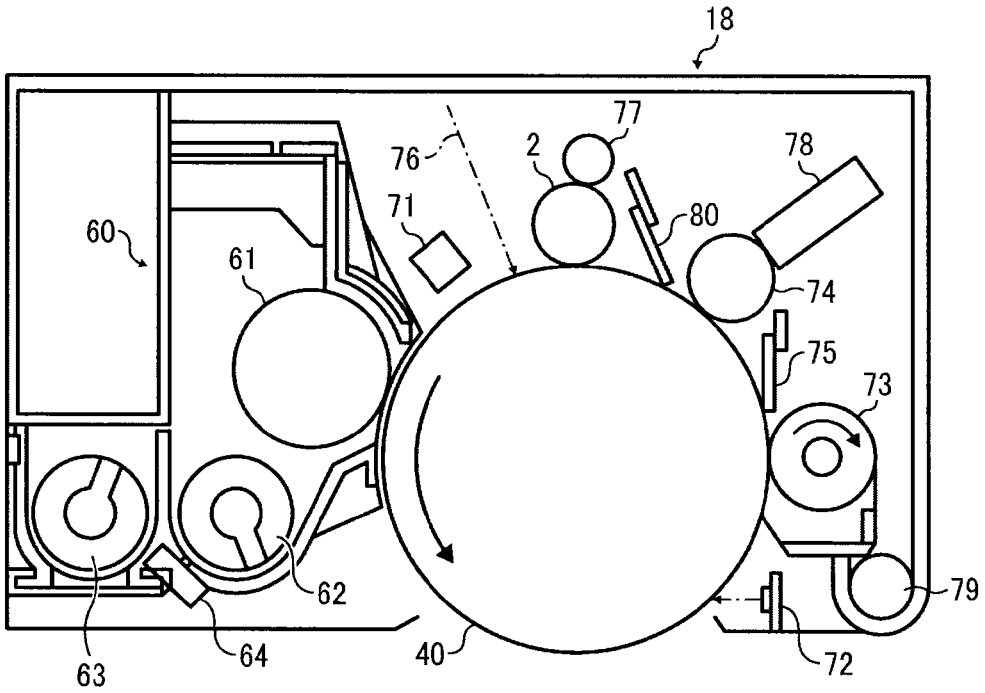
FIG. 3 is a schematic view of another image forming unit mountable on an image forming apparatus according to an embodiment.

According to another embodiment, as illustrated in FIG. 3, the solid lubricant 78, the lubricant supply brush 74, and a lubricant application blade 80 may be disposed downstream from the cleaning blade 75. In this embodiment, the lubricant is more stably supplied to the photoreceptor 40 even when the amount of untransferred or retransferred toner particles input into the cleaning device is varied.

Figure 4:
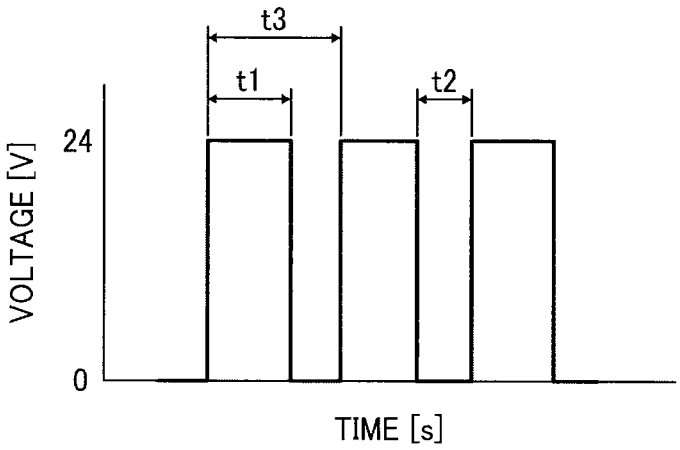
FIG. 4 is a control diagram of the amount of neutralization light in an image forming apparatus according to an embodiment.

FIG. 4 is a control diagram of the amount of neutralization light. The amount of neutralization light is varied by pulse-width modulating the time period during which a voltage of 24 V is input to the neutralization lamp 72.

In FIG. 4, t1 represents an emission time period, t2 represents an extinction time period, t3=t1+t2 represents a modulation period, 1/t3 represents a modulation frequency, and t1/t3 represents an emission duty.

The greater the emission duty, the greater the amount of neutralization light emitted to the photoreceptor 40.

Here, the amount of neutralization light is defined by the amount of light emitted to unit area of the photoreceptor 40. In the present embodiment, the modulation frequency (1/t3) is higher enough than the linear speed of the photoreceptor 40. Therefore, the amount of neutralization light is substantially represented by the sum of continuous rectangular areas each having a width of t1 defined in the control diagram illustrated in FIG. 4.

When an AC charging bias is supplied to the charging roller 2, the inequation fAC/V>5 is satisfied, wherein fAC (Hz) represents a frequency of the AC charging bias and V (mm/s) represents a linear speed of the photoreceptor 40, so as to prevent the photoreceptor 40 from being unevenly charged in a stripe pattern (this phenomena is hereinafter referred to as "uneven charging").

Table 1 shows a relation between the frequency (fAC) of the AC charging bias and image quality when the linear speed (V) of the photoreceptor 40 is kept 350 mm/s.

TABLE 1

| | AC Charging Bias Frequency: fAC (Hz) | | | | |
|---|---|---|---|---|---|
| | 1,050 | 1,750 | 2,650 | 3,150 | 3,850 |
| fAC/V (Linear Speed of Photoreceptor: V = 350 mm/s) | 3 | 5 | 7.5 | 9 | 11 |
| Image Quality | Poor | Good | Good | Good | Poor |

As shown in Table 1, when the ratio of the frequency (fAC) of the AC charging bias to the linear speed (V) of the photoreceptor 40 is relatively small, i.e., fAC/V<5, the resulting image quality is poor due to the occurrence of uneven charging. When the frequency (fAC) is too high, the resulting image quality is good at the initial stage but deteriorates with time due to the occurrence of filming problem in which toner forms an undesirable film on the photoreceptor 40.

Thus, one approach for producing high quality image is to set the frequency (fAC) of the AC charging bias not to be too higher than the linear speed (V) of the photoreceptor.

In view of the above relation between the linear speed (V) of the photoreceptor 40 and the frequency (fAC) of the AC charging bias, it can be predicted that the photoreceptor 40 may be unevenly neutralized (this phenomenon is hereinafter referred to as "uneven neutralization") when the pulse-width modulation frequency in the neutralization is too smaller than the linear speed (V) of the photoreceptor 40.

Table 2 shows a relation between the modulation frequency (f) of the pulse-width modulation in the neutralization and image quality (i.e., unevenness) when the linear speed (V) of the photoreceptor 40 is kept 350 mm/s.

TABLE 2

| | Neutralization Modulation Frequency: f (Hz) | | | |
|---|---|---|---|---|
| | 750 | 1750 | 20000 | 50000 |
| f/V (Linear Speed of Photoreceptor: V = 350 mm/s) | 2 | 5 | 57 | 143 |
| Image Quality (Unevenness) | Average | Good | Good | Good |

As shown in Table 2, when the ratio of the modulation frequency (f) of the pulse-width modulation to the linear speed (V) of the photoreceptor 40 is relatively small, i.e., f/V<5, the resulting image quality is poor due to the occurrence of uneven neutralization.

Therefore, in the present embodiment, the inequation f/V>5 is satisfied.

Since the amount of neutralization light is varied according to the image forming speed (i.e., the linear speed (V) of the photoreceptor 40), the amount of neutralization light does not become either insufficient or excessive, thus suppressing the production of abnormal images and the occurrence of photoreceptor fatigue.

In other words, since the duty of the pulse-width modulation in the neutralization is varied according to the image forming speed, the amount of neutralization light can be easily varied, thus suppressing the production of abnormal images and the occurrence of photoreceptor fatigue.

On the other hand, when the modulation frequency is too high, the amount of neutralization light is less controllable due to the effects of dull wave shape at rising and falling edges of input pulse and LED emission rise time. Therefore, in some embodiments, the modulation frequency is set 200 kHz or less.

When the modulation frequency is 200 kHz or less, the amount of neutralization light is precisely controlled because the neutralization lamp 72 stably emits light.

In a case in which the charging roller 2 is supplied with an AC charging bias having a similar frequency (fAC) to the modulation frequency (f) in the neutralization, a frequency interference is caused. As a result, low-frequency potential unevenness may appear on the photoreceptor 40.

When the frequency (fAC) of the AC charging bias is too high, as shown in Table 1, the resulting image quality is poor because photoreceptor abrasion is accelerated and the filming problem easily occurs due to the occurrence of excessive electric discharge.

These undesirable phenomena can be reliably avoided when the modulation frequency (f) in the neutralization is 200 kHz or less. In some embodiments, the modulation frequency (f) in the neutralization is greater enough than the frequency (fAC) of the charging bias, in particular, the inequation f/fAC>5 is satisfied.

When the modulation frequency (f) in the neutralization is greater enough than the frequency (fAC) of the charging bias, a frequency interference is not caused, and therefore low-frequency potential unevenness does not appear on the photoreceptor 40.

Example 1

In accordance with an embodiment, the image forming apparatus illustrated in FIG. 1 including the image forming unit 18 illustrated in FIG. 2 and the charging roller 2 illustrated in FIG. 5 (to be described in detail later) is provided. The linear speed of the photoreceptor 40 can be set to three levels of speed, i.e., normal speed (for normal paper), middle speed (for normal paper), and low speed (for thick paper).

The frequency of the AC charging bias is variable according to the linear speed of the photoreceptor 40. The modulation frequency in the neutralization is kept 20 kHz regardless of the linear speed of the photoreceptor 40. The emission duty in the neutralization is variable according to the linear speed of the photoreceptor 40. Various combinations of linear speed of the photoreceptor 40, frequency of the AC charging bias, and emission duty are shown in Table 3.

Here, varying the emission duty is synonymous with varying the emission time period t1 defined in FIG. 4.

TABLE 3

| | Linear speed of photoreceptor: V (mm/s) | | |
|---|---|---|---|
| | Normal Speed | Middle Speed | Low Speed |
| AC charging bias frequency: fAC (Hz) | 2,650 | 1,850 | 1,330 |
| Emission Duty in Neutralization (%) | 80 | 55 | 40 |

In all the above combinations, high quality image is obtained without causing uneven neutralization and/or charging regardless of the linear speed of the photoreceptor 40.

According to Table 3, fAC/V is about 7.6 at the normal speed, about 7.7 at the middle speed, and 7.6 at the low speed. In some embodiments, the inequation 9>fAC/V>5 is satisfied.

According to some embodiments, the modulation frequency (f) in the neutralization can be also variable. However, when the modulation frequency (f) in the neutralization is constant regardless of the linear speed (V) of the photoreceptor 40, control circuit is more simple and lower in cost. The modulation frequency (f) in the neutralization can be set as high as possible so long as the LED can emit light.

Figure 6:
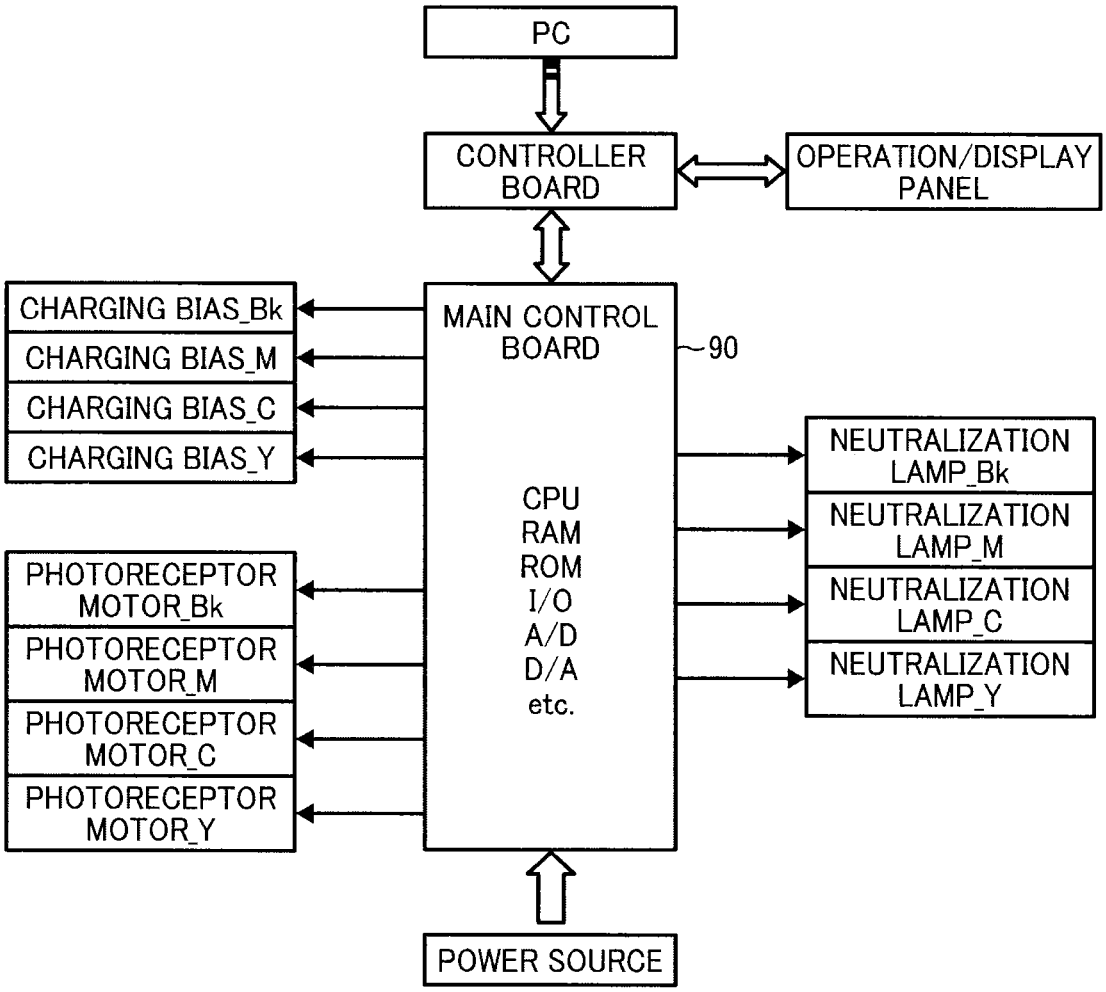
FIG. 6 is a control diagram for varying the emission duty of a neutralizer in an image forming apparatus according to an embodiment.

FIG. 6 is a control diagram for varying the emission duty according to the linear speed of the photoreceptor.

When a controller board receives a print command from a personal computer connected to a network or a copy command is set at the operation panel, the controller board determines image forming conditions and sends a command to a main control board 90 serving as a varying device adapted to vary the amount of neutralization light to be emitted to the photoreceptors. The main control board 90 is adapted to operate the photoreceptor motors, charging biases, and neutralization lamps under predetermined conditions according to the command.

In some embodiments, the main control board 90 operates such that each photoreceptor satisfies the inequations f/V>5, 9>fAC/V>5, and f/fAC>5 regardless of the linear speed (V), the pulse-width modulation frequency (f) is constant regardless of the linear speed (V), and the emission duty increases as the linear speed (V) increases.

By varying the emission duty according the linear speed (V), the amount of neutralization light can be easily set to an appropriate value. By setting the pulse-width modulation frequency (f) such that the above inequations are satisfied regardless of the linear speed (V), it is not necessary to vary the pulse-width modulation frequency (f) depending on the linear speed (V), which results in a low-cost configuration.

Example 2

The organic photoreceptor is gradually abraded and the photosensitive layer is thinned in a long-term use, along with increase of electrostatic capacitance and decrease of sensitivity. When the amount of neutralization light is controlled based on Table 1 at the initial stage and gradually increased thereafter, the amount of neutralization light is maintained at an appropriate value even when the photoreceptor is abraded, thus suppressing the production of abnormal images and the occurrence of photoreceptor fatigue.

It is easy to finely adjust the amount of neutralization light because the amount of neutralization light is controlled by pulse-width modulation. The abrasion volume of the photoreceptor can be estimated by previously determine the relation between rotation time and abrasion volume and the relation between revolution and abrasion volume, and memorizing the rotation time and revolution.

The abrasion volume may be calculated based on information regarding the rotation time and revolution, or alternatively based on a table control in which experimentally-obtained data is extracted.

Since the amount of neutralization light is controlled based on the detected or estimated abrasion volume of the photoreceptor, in other words, the amount of neutralization light is controlled according to sensitivity of the photoreceptor, the production of abnormal images and the occurrence of photoreceptor fatigue are suppressed.

The linear speed of the photoreceptor 40, frequency (fAC) of the AC charging bias, modulation frequency (f) in the neutralization, and emission duty in the neutralization are not limited to the above-described values.

In the above embodiment, the main control board 90 serves as a varying device adapted to vary the amount of neutralization light, and can be also serve as a controller for controlling operation of the image forming apparatus.

In the above embodiment, since the amount of neutralization light is varied according to the usage condition of the photoreceptor, the production of abnormal images and the occurrence of photoreceptor fatigue are suppressed.

Figure 5:
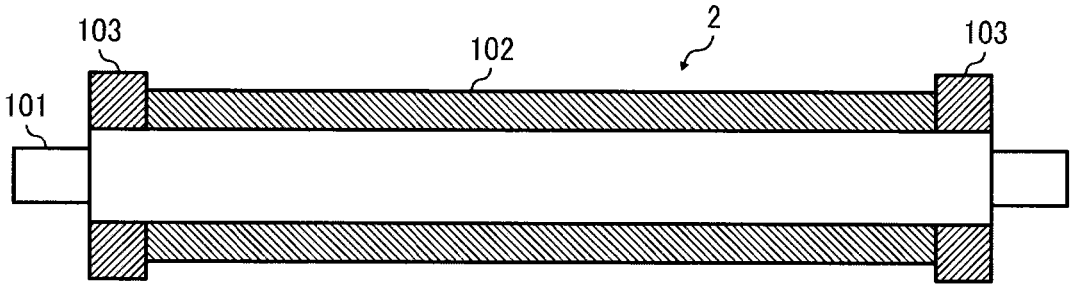
FIG. 5 is a schematic view of a charging roller for use in an image forming apparatus according to an embodiment.

FIG. 5 is a schematic view of the charging roller 2 according to an embodiment. The charging roller 2 includes a conductive cored bar 101, a resin layer 102 serving as a charging member, and a gap retaining member 103.

The cored bar 101 is comprised of a metal such as stainless steel. When the cored bar 101 is too thin, the cored bar 101 is likely to bend at the time the resin layer 102 is formed thereon by cutting processing or the charging roller 2 is pressed against the photoreceptor. Such a bended cored bar has poor gap accuracy. When the cored bar 101 is too thick, the charging roller 2 becomes too big or heavy. Thus, in some embodiments, the cored bar 101 has a diameter of 6 to 10 mm.

In some embodiments, the resin layer 102 is comprised of a material having a volume resistivity of $10^4$ to $10^9$ Ωcm. When the volume resistivity it too small, the charging bias may easily leak through a defective pinhole on the photoreceptor, if any. If the volume resistivity is too large, electric discharge may not sufficiently occur and an uniform charging potential cannot be obtained. The volume resistivity can be controlled by mixing the base resin with a conductive material.

Specific examples of usable base resins include, but are not limited to, polyethylene, polypropylene, polymethyl methacrylate, polystyrene, acrylonitrile-butadiene-styrene copolymer, and polycarbonate. These materials have high moldability.

Specific examples usable conductive materials include, but are not limited to, ionic conductive materials such as polymer compounds having a quaternary ammonium salt group. The polymer compounds having a quaternary ammonium salt group may be, for example, polyolefins (such as polyethylene, polypropylene, polybutene, polyisoprene, ethylene-ethyl acrylate copolymer, ethylene-methyl acrylate copolymer, ethylene-vinyl acetate copolymer, ethylene-propylene copolymer, and ethylene-hexene copolymer) having a quaternary ammonium salt group.

The ionic conductive material may be uniformly mixed with the base resin by a twin-axis extruder or a kneader. The mixed material is formed into a roller-like shape on the cored bar 101 by injection molding or extrusion molding. In some embodiments, 30 to 80 parts by weight of the ionic conductive material is mixed with 100 parts by weight of the base material.

In some embodiments, the resin layer 102 has a thickness of 0.5 to 3 mm. Too thin a resin layer is difficult to mold and is low in strength. When the resin layer 102 is too thick, the charging roller 2 becomes too large and the resistivity of the resin layer 102 becomes too large, resulting in deterioration of charging efficiency.

According to an embodiment, the charging roller 2 may be prepared by forming the resin layer 102 on the cored bar 101 and press-fitting and/or adhering the gap retaining member 103 to both ends of the resin layer 102 to fix them to the cored bar 101. The outer diameter of the charging roller 2 is adjusted by cutting or grinding processing after the resin layer 102 and the gap retaining member 103 are integrated as above. By this process, the gap defined between the resin layer 102 and the gap retaining member 103 can be kept constant.

Specific examples of usable materials for the gap retaining member 103 include, but are not limited to, polyethylene, polypropylene, polymethyl methacrylate, polystyrene, acrylonitrile-butadiene-styrene copolymer, and polycarbonate. In some embodiments, the gap retaining member 103 is comprised of a material having a lower hardness than the resin layer 102, so that the gap retaining member 103 does not scratch the photoreceptor. Materials which can provide slidable surface without damaging the photoreceptor are also usable, such as polyacetal, ethylene-ethyl acrylate copolymer, polyvinylidene fluoride, tetrafluoroethylene-perfluoroalkyl vinyl ether copolymer, and tetrafluoroethylene-hexafluoropropylene copolymer.

In some embodiments, the resin layer 102 and/or the gap retaining member 103 have/has a surface layer or coating having a thickness of about several tens micro meter which repels toner.

The gap retaining member 103 is brought into contact with non-image-forming area on the photoreceptor 40 to define a gap between the resin layer 102 and the photoreceptor 40. Gears on both ends of the cored bar 101 are engaged with gears on both flanges of the photoreceptor 40. Therefore, the charging roller 2 is rotated as the photoreceptor 40 is rotated by the photoreceptor driving motor. Since the resin layer 102 is not brought into contact with the photoreceptor 40, image-forming area on the photosensitive layer is not damaged even when the resin layer 102 comprises a hard material or the photoreceptor 40 comprises an organic material. The gap distance is about 100 μm at most because abnormal electric discharge may occur when the gap distance is too large. The charging roller 2, adapted to define a gap between the photoreceptor 40 and the charging roller 2, is compatible with a charging bias in which an AC voltage is overlapped with a DC voltage.

The charging roller 2 can be easily prepared with a high degree of accuracy because resin materials for use in the resin layer 102 and the gap retaining member 103 are easy to process.

According to an embodiment, the cleaning roller 77, adapted to clean the surface of the charging roller 2, is in contact with the charging roller 2. The cleaning roller 77 may be comprised of a metallic cored bar covered with a melamine foam. The cleaning roller 77 is in contact with the charging roller 2 by its own weight and is rotated as the charging roller 2 rotates. The cleaning roller 77 removes contaminants from the surface of the charging roller 2 while being rotated.

In some embodiments, the cleaning roller 77 is in continuous contact with the charging roller 2. In other embodiments, the cleaning roller 77 is intermittently brought into contact with the charging roller 2 on a periodic basis.

According to an embodiment, the developing device 60 employs a two-component developing method. The developing device 60 stores a two-component developer comprising toner and carrier.

The developing device 60 includes a developing roller 61 disposed facing the photoreceptor 40, screws 62 and 63 adapted to convey and agitate developer, and a toner concentration sensor 64. The developing roller 61 is comprised of a rotatable sleeve and a magnet fixed inside the sleeve. Toner is supplied from a toner supply device to the developing device 60 based on the output from the toner concentration sensor 64.

The toner is comprised of a binder resin, a colorant, a charge controlling agent, and other optional additives. Usable binder resins include, but are not limited to, polystyrene, styrene-acrylate copolymer, and polyester resin. Usable colorants include all colorants usable for toner. The content of colorant may be 0.1 to 15 parts by weight based on 100 parts by weight of the binder resin.

Usable charge controlling agents include, but are not limited to, nigrosine dyes, chromium-containing complexes, and quaternary ammonium salts. Selecting which material to use is based on the polarity of toner. The content of charge controlling agent may be 0.1 to 10 parts by weight based on 100 parts by weight of the binder resin.

The toner may further include a fluidizer. Specific materials usable as the fluidizer include, but are not limited to, fine particles of metal oxides such as silica, titania, and alumina; the above fine particles surface-treated with a silane-coupling agent or titanate-coupling agent; and fine particles of polymer such as polystyrene, polymethyl methacrylate, and polyvinylidene fluoride. The fluidizer may have a particle diameter of 0.01 to 3 μm. The content of fluidizer may be 0.1 to 0.7 parts by weight based on 100 parts by weight of the toner.

The toner may be prepared by, for example, a kneading-pulverization process in which a binder resin, a colorant, and other materials are mixed in a dry condition, the mixture is melt-kneaded by an extruder, double rolls, or triple rolls under heat, followed by cooling, the solidified mixture is pulverized into particles by a jet mill, and the particles are classified by size by an airflow classifier. The toner may be also prepared by a suspension polymerization process or a non-aqueous dispersion polymerization process in both of which toner is directly obtained from a monomer, a colorant, and other materials.

The carrier may be comprised of a core material only or that covered with a covering layer. Usable core materials include, but are not limited to, ferrite and magnetite. The core material may have a particle diameter of 20 to 60 μm.

Specific materials usable for the covering layer include, but are not limited to, vinylidene fluoride, tetrafluoroethylene, hexafluoropropylene, perfluoroalkyl vinyl ether, fluorine-substituted vinyl ether, and fluorine-substituted vinyl ketone. The covering layer may be formed by, for example, spraying or dipping method.

According to an embodiment, the photoreceptor 40 comprises an organic photoreceptor including a conductive support and a photosensitive layer. The photosensitive layer includes a charge generation layer and a charge transport layer.

The conductive support may comprise a conductive material having a volume resistivity not greater than 10 Ω·cm. Usable conductive materials include, for example, plastic films or cylinders and paper sheets, on the surface of which a metal (e.g., aluminum, nickel, chromium, nichrome, copper, silver, gold, platinum) or a metal oxide (e.g., tin oxide, indium oxide) is deposited or sputtered; and metallic cylinders (e.g., aluminum, aluminum alloy, nickel, stainless steel), the surfaces of which are processed by cutting, super finishing, polishing, and the like treatments. The charge transport layer includes a charge transport material as a main component.

Specific examples of the charge generation material include, but are not limited to, inorganic and organic materials such as monoazo pigments, disazo pigments, trisazo pigments, perylene pigments, quinacridone pigments, quinone-based condensed polycyclic compounds, squaric acid dyes, phthalocyanine pigments, naphthalocyanine pigments, azulenium salt dyes, selenium, selenium-tellurium alloys, selenium-arsenic alloys, and amorphous silicone. Two or more of these charge generation materials can be used in combination.

The charge generation layer may be formed by dispersing the charge generation material and an optional binder resin in a solvent (e.g., tetrahydrofuran, cyclohexanone, dioxane, 2-butanone, dichloroethane) with a ball mill, an attritor, or a sand mill, and applying the resulting coating liquid by dip coating, spray coating, or bead coating.

Usable optional binder resins include, but are not limited to, polyamide, polyurethane, polyester, epoxy, polyketone, polycarbonate, silicone, acrylic, polyvinyl butyral, polyvinyl formal, polyvinyl ketone, polystyrene, polyacrylic, and polyamide resins. The content of the binder resin may be 0 to 2 parts by weight based on 1 part of the charge generation material.

The charge generation layer may be formed by a vacuum thin-film forming method. The charge generation layer may have a thickness of 0.01 to 5 μm or 0.1 to 2 μm.

The charge transport layer may be formed by dissolving or dispersing a charge transport material and a binder resin in a solvent and applying the resulting coating liquid, followed by drying. The charge transport layer may further include a plasticizer and/or a leveling agent.

Usable charge transport materials include low-molecular-weight charge transport materials including electron transport materials and hole transport materials. Specific examples of the electron transport materials include, but are not limited to, electron-accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. Two or more of these electron transport materials can be used in combination.

Specific examples of the hole transport materials include, but are not limited to, electron-donating materials such as oxazole derivatives, oxadiazole derivatives, imidazole derivatives, triphenylamine derivatives, 9-(p-diethylaminostyrylanthracene), 1,1-bis-(4-dibenzylaminophenyl)propane, styryl anthracene, styryl pyrazoline, phenyl hydrazone, α-phenylstilbene derivatives, thiazole derivatives, triazole derivatives, phenazine derivatives, acridine derivatives, benzofuran derivatives, benzimidazole derivatives, and thiophene derivatives. Two or more of these hole transport materials can be used in combination.

Usable binder resins for the charge transport layer include, but are not limited to, thermoplastic and thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy, polycarbonate, cellulose acetate, ethyl cellulose, polyvinyl butyral, polyvinyl formal, polyvinyl toluene, acrylic, silicone, epoxy, melamine, urethane, phenol, and alkyd resins.

Usable solvents include, but are not limited to, tetrahydrofuran, dioxane, toluene, 2-butanone, monochlorobenzene, dichloroethane, and methylene chloride. The charge transport layer may have a thickness of 10 to 40 μm.

Specific examples of usable plasticizers for the charge transport layer include, but are not limited to, dibutyl phthalate and dioctyl phthalate. The content of the plasticizer may be 0 to 30% by weight based on the binder resin.

Specific examples of usable leveling agents for the charge transport layer include, but are not limited to, silicone oils (e.g., dimethyl silicone oil, methyl phenyl silicone oil) and polymers or oligomers having a perfluoroalkyl-group-containing side chain. The content of the leveling agent may be 0 to 1% by weight based on the binder resin.

In some embodiments, the content of charge transport material in the photosensitive layer is 30% by weight or more. When the content is less than 30% by weight, it is difficult to provide a sufficient length of optical attenuation time when the photoreceptor is irradiated with pulse laser light in high-speed electrophotographic process.

In some embodiments, the photoreceptor 40 further includes an undercoat layer between the conductive support and the photosensitive layer. The undercoat layer includes a resin as a main component. Since the photosensitive layer coating liquid, including a solvent, is applied to the undercoat layer, the resin is required to have high resistance to the solvent.

Specific examples of such resins include, but are not limited to, water-soluble resins such as polyvinyl alcohol, casein, and sodium polyacrylate; alcohol-soluble resins such as copolymerized nylon and methoxymethylated nylon; and hardened resins having a three-dimensional network structure such as polyurethane, melamine, alkyd-melamine, and epoxy resins.

The undercoat layer may further include fine powders of metal oxides such as titanium oxide, silica, alumina, zirconium oxide, tin oxide, and indium oxide, to prevent the occurrence of moiré and to reduce residual potential. The undercoat layer can be formed by a typical coating method using a proper solvent, in the same way as the formation of the above-described layers.

The undercoat layer may be a metal oxide layer formed by a sol-gel method using a silane coupling agent, titanium coupling agent, or chromium coupling agent. Alternatively, the undercoat layer may be a layer formed by anodic oxidization of $Al_2O_3$; or a layer of an organic material (e.g., polyparaxylene (parylene)) or an inorganic material (e.g., SiO, $SnO_2$, $TiO_2$, ITO, $CeO_2$) formed by a vacuum thin-film forming method. The undercoat layer may have a thickness of 0 to 5 μm.

In some embodiments, the photoreceptor 40 further includes a protective layer on the photosensitive layer for the purpose of protecting the photosensitive layer and improving durability.

The protective layer includes a binder resin and fine particles of metal oxides such as alumina, silica, titanium oxide, tin oxide, zirconium oxide, and indium oxide, for the purpose of improving abrasion resistance. Usable binder resins include, but are not limited to, styrene-acrylonitrile copolymer, styrene-butadiene copolymer, acrylonitrile-butadiene-styrene copolymer, olefin-vinyl monomer copolymer, chlorinated polyether, aryl, phenol, polyacetal, polyamide, polyamide-imide, polyacrylate, polyarylsulfone, polybutylene, polybutylene terephthalate, polycarbonate, polyether sulfone, polyethylene, polyethylene terephthalate, polyimide, acrylic, polymethylpentene, polypropylene, polyphenylene oxide, polysulfone, polyurethane, polyvinyl chloride, polyvinylidene chloride, and epoxy resins.

The content of the fine particles of metal oxide in the protective layer may be 5 to 30% by weight. When the content is less than 5% by weight, abrasion resistance or durability may not be improved. When the content is greater than 30% by weight, when the photoreceptor is irradiated with light, bright section potential increases too much and sensitivity deteriorates. The protective layer can be formed by a spray coating method, for example.

The protective layer may have a thickness of 1 to 10 μm or 3 to 8 μm. When the protective layer is too thin, durability may be poor. When the protective layer is too thick, manufacturability of the photoreceptor may decrease and residual potential may increase with time. The fine particles of metal oxide may have a particle diameter of 0.1 to 0.8 μm.

When the particle diameter is too large, the surface of the protective layer may be too rough to completely remove residual toner particles therefrom. Additionally, such a rough protective layer is likely to scatter irradiation light, resulting in production of low quality image with low resolution. When the particle diameter is too small, abrasion resistance may be poor.

The protective layer may further include a dispersing auxiliary agent for the purpose of improving dispersibility of the fine particles of metal oxide in the binder resin. The content of the dispersing auxiliary agent may be 0.5 to 4% by weight or 1 to 2% by weight based on the fine particles of metal oxide.

The protective layer may further include a charge transport material for the purpose of accelerating migration of charge in the protective layer. Charge transport materials usable for the protective layer include the same materials usable for the charge transport layer.

Each of the layers described above may include an antioxidant, a plasticizer, an ultraviolet absorber, and/or a leveling agent for the purpose of improving environmental resistance, i.e., so as not to decrease sensitivity or not to increase residual potential.

Additional modifications and variations in accordance with further embodiments of the present invention are possible in light of the above teachings. It is therefore to be understood that within the scope of the appended claims the invention may be practiced other than as specifically described herein.

What is claimed is:

1. An image forming apparatus, comprising:

an image bearing member;

a charger adapted to charge the image bearing member;

an irradiator adapted to irradiate the charged image bearing member with light to form an electrostatic latent image thereon;

a developing device adapted to develop the electrostatic latent image into a toner image with toner;

a transfer device adapted to transfer the toner image from the image bearing member;

a neutralizer adapted to neutralize the image bearing member by emitting neutralization light thereto; and a varying device adapted to vary an amount of the neutralization light to be emitted to the image bearing member by pulse-width modulation of a voltage to be supplied to the neutralizer, wherein the following formula is satisfied:

$$f/V>5$$

wherein f (Hz) represents a frequency of the pulse-width modulation and V (mm/s) represents a linear speed of the image bearing member wherein the charger is adapted to be supplied with an AC charging bias in which a DC bias is overlapped with an AC bias, and wherein the following inequation is satisfied:

$$f/fAC>5$$

wherein fAC (Hz) represents a frequency of the AC charging bias.

2. The image forming apparatus according to claim 1, wherein the frequency of the pulse-width modulation is 200 kHz or less.

3. The image forming apparatus according to claim 1, wherein the following inequation is satisfied:

$$9>fAC/V>5.$$

4. The image forming apparatus according to claim 1, wherein the frequency f (Hz) of the pulse-width modulation is constant regardless of the linear speed V (mm/s) of the image bearing member, and wherein the neutralizer is adapted to increase an emission duty as the linear speed V (mm/s) increases.

5. The image forming apparatus according to claim 1, wherein the image bearing member comprises an organic photoreceptor, and wherein the neutralizer comprises a light-emitting diode adapted to emit light having a wavelength of 600 to 800 nm.

6. The image forming apparatus according to claim 1, wherein the amount of the neutralization light is varied according to the linear speed V (mm/sec) of the image bearing member.

7. The image forming apparatus according to claim 1, wherein the amount of the neutralization light is varied according to an abrasion volume of the image bearing member.

8. The image forming apparatus according to claim 1, wherein a number of the image bearing member is two or more, and wherein the amount of the neutralization light to be emitted to each image bearing member is independently controllable.

* * * * *